US005379622A

United States Patent [19]

Saito et al.

[11] Patent Number: 5,379,622

[45] Date of Patent: Jan. 10, 1995

[54] METHOD OF FORMING HELICAL SPLINES WITH STOPPERS ON A ROTARY SHAFT, AND ROLLING TOOLS FOR PRACTICING THE METHOD

[75] Inventors: Mitsuo Saito; Yoshihiro Umebayashi; Shigetake Aoyagi, all of Aichi; Shuzo Isozumi, Hyogo; Noriyuki Tanaka, Hyogo; Junichi Kasa, Hyogo, all of Japan

[73] Assignees: Mitsubishi Denki Kabushiki Kaisha, Tokyo; O S G Corporation, Aichi, both of Japan

[21] Appl. No.: 120,466

[22] Filed: Sep. 14, 1993

[30] Foreign Application Priority Data

Sep. 16, 1992 [JP] Japan ..... 4-245387

[51] Int. Cl.[6] ..... B21H 3/00

[52] U.S. Cl. ..... 72/88; 72/469

[58] Field of Search ..... 72/88, 90, 469, 102, 72/103

[56] References Cited

U.S. PATENT DOCUMENTS

| | | | |
|---|---|---|---|
| 446,739 | 2/1891 | Jones | 72/88 |
| 2,165,007 | 7/1939 | Rosenberg | 72/88 |
| 3,872,700 | 3/1975 | Matej | 72/469 |
| 4,028,922 | 6/1977 | Killop | 72/88 |
| 4,691,551 | 9/1987 | H053812384 | 72/88 |
| 4,782,688 | 11/1988 | Kawashima | 72/88 |
| 4,902,905 | 2/1990 | Morishita . | |

*Primary Examiner*—Daniel C. Crane

*Attorney, Agent, or Firm*—Sughrue, Mion, Zinn, Macpeak & Seas

[57] ABSTRACT

In forming helical splines with stoppers on a rotary shaft, its large-diameter portion is held between a pair of rolling tools, each of which comprises: a helical teeth forming die having inclined teeth; an aligning teeth die having aligning teeth which are aligned with every other inclined tooth when combined with the helical teeth forming die; and a finishing teeth die having finishing teeth which are equal in pitch to the aligning teeth. Under this condition, the shaft is rolled under pressure by moving the rolling tools, to form helical grooves, and communication grooves communicated with every other helical grooves on the large-diameter portion, leaving stoppers between the communication grooves. Hence, the helical splines are formed by one rolling operation, with burrs formed between the spline grooves and the communication grooves being automatically removed.

5 Claims, 3 Drawing Sheets

METHOD OF FORMING HELICAL SPLINES WITH STOPPERS ON A ROTARY SHAFT, AND ROLLING TOOLS FOR PRACTICING THE METHOD

BACKGROUND OF THE INVENTION

This invention relates to a method of forming helical splines with stoppers on a rotary shaft, and rolling tools for practicing the method.

In an example of a starter motor, as disclosed by Japanese Utility Patent Application (OPI) No. 53727/1980 (the term "OPI" as used herein means an "unexamined application") its output shaft has helical splines with stoppers, and it is spline-coupled to the sleeve of the clutch outer of an overrunning clutch while being prevented from moving axially by the stoppers.

A method of forming the output shaft will be described with reference to FIG. 5. First, as shown in the part (A) of FIG. 5, a round rod of steel is cold-forged and machined into a shaft 1 having a flange 1*a*, a relief 1*b*, a large-diameter portion 1*c*, and a small-diameter portion 1*d*. Thereafter, as shown in the part (B) of FIG. 5, the large-diameter portion 1*c* is rolled being held between a pair of rolling tools 2 which are set on the shaft 1 in such a manner that they are turned 180° from each other.

Each of the rolling tools 2 is as shown in the part (A) of FIG. 6. In the part (a) of FIG. 6, 3 designates a helical teeth forming die having a plurality of inclined teeth 3*a*; and 4, an aligning teeth die having a plurality of aligning teeth 4*a*, which are aligned with every other inclined tooth of the helical teeth forming die 3. The helical teeth forming die 3 and the aligning teeth die 4 are joined to each other as shown in the part (B) of FIG. 6, thus forming the rolling tool.

The part (C) of FIG. 5 shows a rotary shaft 5 which is formed by rolling the large-diameter portion of the shaft 1 as shown in the part (B) of FIG. 5. That is, the large-diameter portion 1*c* of the rotary shaft 5 has helical splines 6 having a plurality of helical grooves 6*a* (for instance ten helical grooves), communication grooves 7*a* communicated with every other helical groove 6*a*, and stoppers 7 between the communication grooves 7*a*.

Manufacturing the rotary shaft 5 suffers from a difficulty in that small burrs 8 are liable to be formed between the helical grooves 6*a* and the communication grooves 7*a* communicated with the latter 6*a*. That is, each rolling tool 2 is formed by combining the helical teeth forming die 3 and the aligning teeth die 4 with each other. In this tool forming operation, there is formed a small gap between the dies 3 and 4 depending on the machining accuracy of them. The small gap thus formed results in formation of the burrs 8 between the helical grooves 6*a* and the communication grooves 7*a*. The burrs 8 thus formed give rise to difficulties as follows: When an element to be driven by the rotary shaft is to be spline-coupled to the latter, the burrs 8 obstruct the movement of the element along the rotary shaft. The burrs 8 may come off to enter the spaces between the splines, thereby to obstruct the sliding of the element. In order to eliminate the above-described difficulties, heretofore the burrs are removed by hand finishing.

In order to eliminate the formation of the burrs 8 at the helical grooves 6, another method of forming helical splines with stoppers has been proposed in the art. The method is as shown in FIG. 7. That is, as shown in the part (A) of FIG. 7, a round rod of steel is cold-forged and machined into a shaft 1 having a flange 1*a*, a relief 1*b*, a large-diameter portion 1*e*, an annular groove 1*f*, a stopper 1*g*, and a small-diameter portion 1*d*. In the shaft 1 thus formed, the outside diameter of the annular groove 1*f* is smaller than the diameter of helical grooves 6*a* and communication grooves 7*a* which are formed on the shaft 1 by rolling it later. The shaft 1 is processed as follows: Similarly as in the case of the part (B) of FIG. 5, the shaft 1 is rolled under pressure with the large-diameter portion 1*e* and the stopper 1*g* held between a pair of rolling tools 2. The shaft 1 thus rolled has helical splines 6 having a plurality of helical grooves 6*a*, communication grooves 7*a* aligned with every other helical groove 6*a*, and stoppers 7 between the communication grooves 7*a*. That is, an aimed shaft 9 has been formed. In the rolling of the shaft 1, no burrs are formed, because when the helical teeth forming die 3 and the aligning teeth die 4 are set on the shaft 1, the junction of those dies is located over the annular groove 1*f*.

The conventional method described with reference to FIG. 5, as was described above, is disadvantageous in that the burrs 8 are formed between the spline grooves 6*a* and the communication grooves 7*a*, and therefore it is necessary to remove the burrs 8; that is, the method is low in productivity.

The conventional method described with reference to FIG. 7 which has solved the problem accompanying the method shown in FIG. 5 provides another problem to be solved. In the method, the shaft 1 has the annular groove 1*f*; that is, the number of manufacturing steps is increased as much. Because of the provision of the annular groove 1*f*, the spline-coupling length of the helical splines 6 with the clutch outer of the over-running clutch is decreased as much, and the bearing stress is higher. This problem may be solved by increasing the length of the helical splines as much as the width of the annular groove 1*f*. However, increasing the length of the helical splines in this manner gives rise to another problem in that the rotary shaft 9 is increased in length as much.

SUMMARY OF THE INVENTION

Accordingly, an object of this invention is to eliminate the above-described difficulties accompanying a conventional method of forming helical splines with stoppers on a rotary shaft.

More specifically, a first object of the invention is to provide a method of forming helical splines with stoppers on a rotary shaft in which it is unnecessary to form the annular groove in the shaft and accordingly it is unnecessary to increase the length of the shaft, and the helical splines are formed by one rolling operation, with burrs formed between the spline grooves and the communication grooves being automatically collapsed and flattened.

A second object of the invention is to provide a rolling tool suitable for practicing the method of the invention.

The first object of the invention has been achieved by the provision of a method of forming helical splines with stoppers on a rotary shaft which, according to the invention, comprises the steps of:

providing a shaft to be processed which has a large-diameter portion and a small-diameter portion; and rolling, with the large-diameter portion held between a pair of rolling tools, the shaft under pressure by moving the pair of rolling tools, to form a plurality of helical grooves, and communication grooves communicated with every other one of the helical grooves on the large-diameter portion, leaving stoppers between the communication grooves, and finishing the communication grooves and every other one of the helical grooves communicated with the communication grooves.

The second object of the invention has been achieved by the provision of a rolling tool for forming helical splines with stoppers which comprises:

a helical teeth forming die having a plurality of inclined teeth at equal intervals;

an aligning teeth die having aligning teeth which are aligned with every other inclined tooth when combined with the helical teeth forming die; and a finishing teeth die having a plurality of finishing teeth which are equal in pitch to the aligning teeth and every other inclined tooth, the finishing teeth die being set downstream of the helical teeth forming die and the aligning teeth die in a shaft rolling operation.

In the rolling tool, the aligning teeth die and the finishing teeth die may be provided as one unit.

When the shaft is rolled under pressure with its large-diameter portion held between the pair of rolling tools, the helical grooves and the communication grooves are formed on the large-diameter portion in such a manner that the latter are communicated with every other helical groove, and simultaneously burrs are formed between the helical grooves and the communication grooves. However, the burrs thus formed are collapsed and flattened by the finishing teeth of the finishing teeth die located after the helical teeth forming die and the aligning teeth die, so that the communication grooves are smoothly communicated with every other one of the helical grooves. Hence, an element having internal helical teeth to be driven by the splined rotary shaft can be smoothly engaged with the latter through the communication grooves by moving it axially.

The nature, utility and principle of the invention will be more clearly understood from the following detailed description and the appended claims when read in conjunction with the accompanying drawing.

Figure 3:
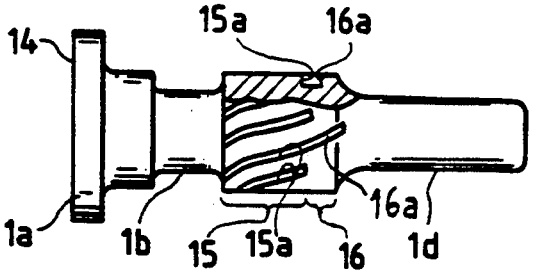
Figure 2A:
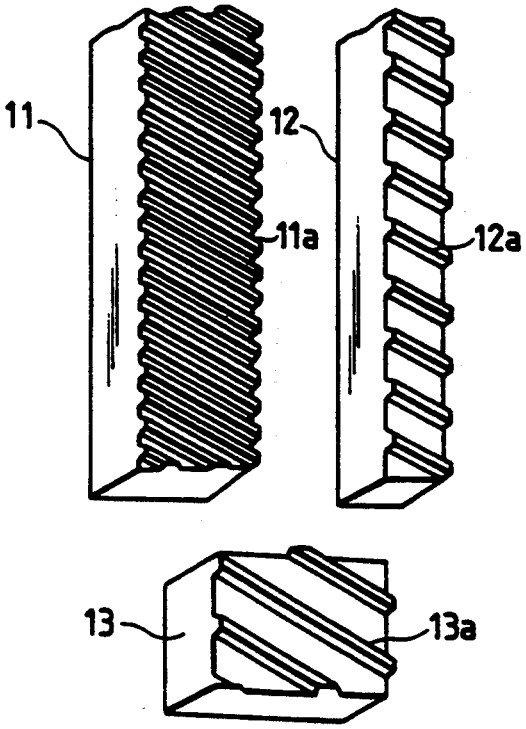
Figure 2B:
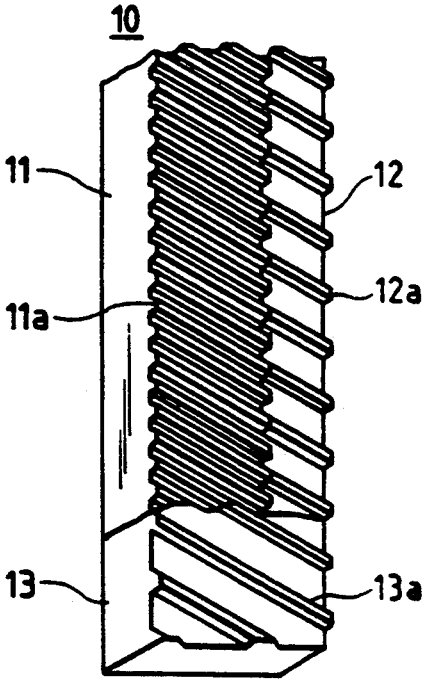

The part (A) of FIG. 2 is an exploded perspective view showing the components of each of a pair of rolling tools employed in the method of the invention; and the part (B) of FIG. 2 is a perspective view showing the rolling tool which is formed by combining those components;

FIG. 3 is a front view, with parts cut away, showing a rotary shaft which is formed according to the method of the invention.

Figure 4A:
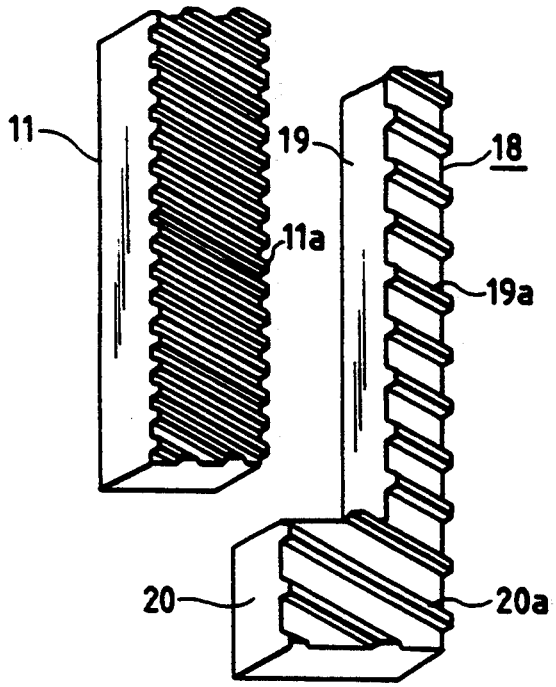
Figure 4B:
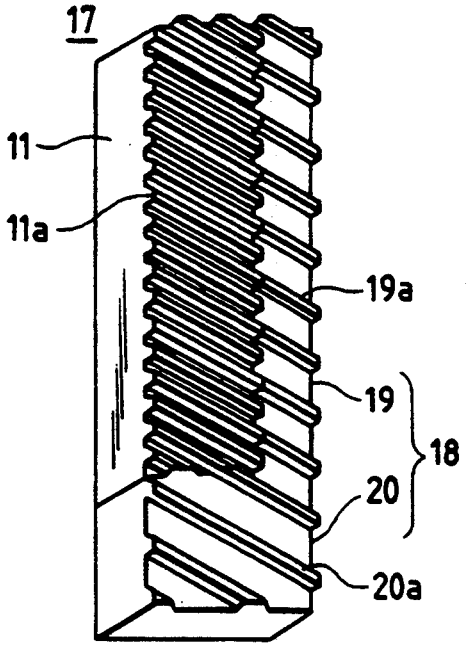
Figure 5A:
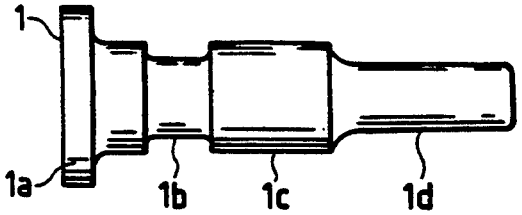
FIG. 5(a) PRIOR ART
Figure 5B:
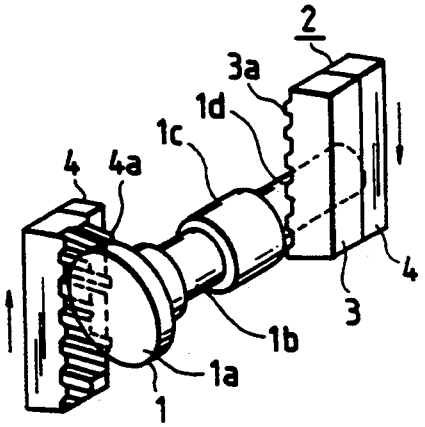
FIG. 5(b) PRIOR ART
Figure 5C:
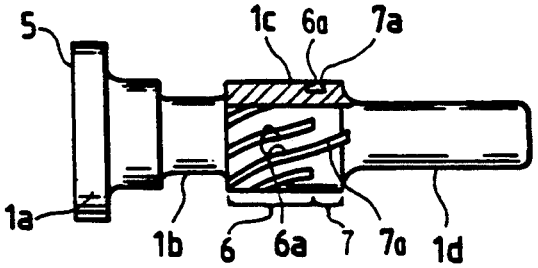
FIG. 5(c) PRIOR ART
Figure 6A:
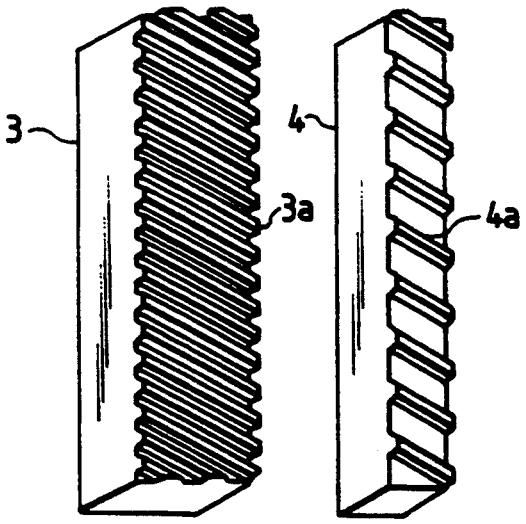
FIG. 6(a) PRIOR ART
Figure 6B:
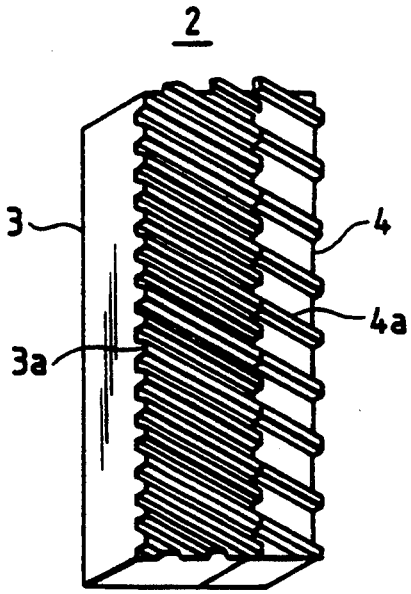
FIG. 6(b) PRIOR ART
Figure 7A:
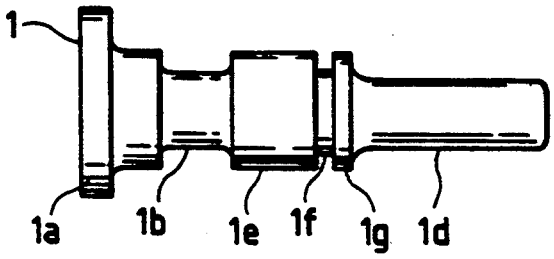
FIG. 7(a) PRIOR ART
Figure 7B:
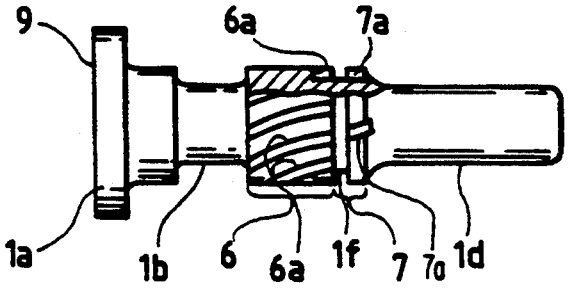
FIG. 7(b) PRIOR ART

The part (A) of FIG. 4 is an exploded perspective view showing the components of one modification of the rolling tool, for a description of another embodiment of the invention, and the part (B) of FIG. 4 is a perspective view showing the modification of the rolling tool which is formed by assembling those components;

The parts (A) through (C) of FIG. 5 are diagrams for a description of one example of a conventional method of forming helical splines with stoppers on a rotary shaft;

The part (A) of FIG. 6 is an exploded perspective view showing the components of each of a pair of rolling tools used in the conventional method, and the part (B) of FIG. 6 is a perspective view showing the rolling tool which is formed by combining those components; and The parts (A) and (B) of FIG. 7 are diagrams for a description of another example of the conventional method.

DETAILED DESCRIPTION OF THE INVENTION

Preferred embodiments of this invention will be described with reference to the accompanying drawings.

First Embodiment

An example of a method of forming helical splines with stoppers on a rotary shaft, which constitutes a first embodiment of the invention, will be described with reference to FIG. 1.

Similarly as in the case of the part (A) of FIG. 5, a shaft 1 to be processed is formed by cold-forging and machining which has a flange 1*a*, a relief 1*b*, a large-diameter portion 1*c*, and a small-diameter portion 1*d*. The shaft 1 is rolled under pressure with the large-diameter portion 1*c* held between a pair of rolling tools 10. The rolling tools 10 are set on the shaft 1 in such a manner that they are turned 180° from each other.

Each of the rolling tools is as shown in the part (A) of FIG. 2. In the part (A) of FIG. 2, reference numeral 11 designates a helical teeth forming die having a number of inclined teeth 11*a*; 12, an aligning teeth die set beside the helical teeth forming die 11, the die 12 having a plurality of aligning teeth 12*a* which are aligned with every other inclined tooth 11*a*; and 13, a burnishing or finishing teeth die set under the helical teeth forming die 11 and the aligning teeth die 12, the die 13 having a plurality of finishing teeth 13*a* which are equal in pitch to the aligning teeth 12*a*. As shown in the part (B) of FIG. 2, the aligning teeth die 12 is located before the helical teeth forming die 11, and the finishing teeth die 13 are set beside the two dies 11 and 12; that is, it is located downstream of those dies 11 and 12 in the rolling operation. The rolling tool 10 is formed by joining those three dies 11, 12 and 13 as described above.

Figure 1:
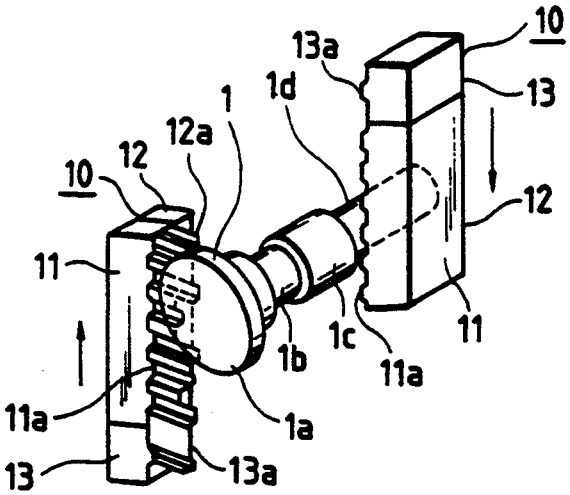
FIG. 1 is a perspective view for a description of a method of forming helical splines with stoppers on a rotary shaft, which constitutes one embodiment of this invention.

The shaft 1 is rolled as shown in FIG. 1. As a result, a rotary shaft having helical splines with stoppers as shown in FIG. 3 is formed. More specifically, the large-diameter portion of the rotary shaft 14 thus formed has helical splines 15 with a plurality of helical grooves 15*a* (for instance ten helical grooves); communication grooves 16*a* which are communicated with every other helical groove 15*a*, and stoppers 16 between the communication grooves 16*a*. Burrs formed between every other helical groove 15*a* and the communication groove 16*a* are collapsed and flattened by the finishing teeth 13*a* of the finishing teeth die 13 of the rolling tool 10.

Second Embodiment

A second embodiment of the invention will be described with reference to FIG. 4 showing another example of the rolling tool employed in the invention. As shown in the part (A) of FIG. 4, the rolling tool 17 according to the invention comprises: a helical teeth forming die 11 having a plurality of inclined teeth 11*a*;

and a combined teeth die 18 which is made up of an aligning teeth section 19, and a finishing teeth section 20. The aligning teeth section 19 has a plurality of aligning teeth 19*a* which are aligned with every other inclined tooth 11, and the finishing teeth section 20 has a plurality of finishing teeth 20*a* which is equal in pitch to the aligning teeth 19*a* of the aligning teeth section 19.

As shown in the part (B) of FIG. 4, the helical teeth forming die 11 and the combined teeth die 18 are joined into one unit, namely, the rolling tool, in such a manner that the aligning teeth section 19 is located beside the helical-tooth forming die 11 while the finishing teeth section 20 is downstream of the die 11 and the section 19 in the rolling operation.

Similarly as in the case of FIG. 1, the shaft 1 is rolled under pressure with the large-diameter portion 1*c* held between the pair of rolling tools 17, to form helical splines with stoppers on it. In this operation, the rolling tools 17 are set on the shaft 1 in such a manner that they are turned 180° from each other.

As was described above, in the method of the invention, the large-diameter portion of the shaft to be processed is held between the pair of rolling tools each of which comprises: the helical teeth forming die having a plurality of inclined teeth; the aligning teeth die having the aligning teeth which are aligned with every other inclined tooth when combined with the helical teeth forming die; and the finishing teeth die having a plurality of finishing teeth which are equal in pitch to the aligning teeth and every other inclined tooth, the finishing teeth die being set below the helical teeth forming die and the aligning teeth die. Under this condition, the shaft is rolled under pressure by moving the rolling tools, to form the helical grooves, and the communication grooves communicated with every other one of the helical grooves on the large-diameter portion, leaving the stoppers between the communication grooves. Hence, the helical splines with the stoppers are formed by one rolling operation, and the burrs formed between the communication grooves and every other helical groove are automatically removed. Therefore, the element to be driven by the rotary shaft can be readily and smoothly spline-coupled to the latter.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A method of forming helical splines with stoppers on a rotary shaft, comprising the steps of:

providing a shaft to be processed which has a large-diameter portion and a small-diameter portion; and rolling, with said large-diameter portion held between a pair of rolling tools, said shaft under pressure by moving said pair of rolling tools, to form a plurality of helical grooves, and communication grooves communicated with every other one of the helical grooves on said large-diameter portion, while leaving stoppers between said communication grooves, said stoppers having a configuration different that said communication and helical grooves, and finishing said communication grooves and every other one of the helical grooves communicated with said communication grooves using a finishing teeth die having a plurality of finishing teeth, so as to collapse and flatten any burrs.

2. A method of forming helical splines with stoppers on a rotary shaft according to claim 1, in which each of said rolling tools comprises:

a helical teeth forming die for processing said plurality of helical grooves, said helical teeth forming die having a plurality of inclined teeth at equal intervals;

an aligning teeth die for processing said communication grooves, said aligning teeth die having aligning teeth which are aligned with every other inclined tooth when combined with said helical teeth forming die; and said finishing teeth die for processing both said plurality of helical grooves and said communication grooves, said plurality of finishing teeth being equal in pitch to said aligning teeth and every other inclined tooth, said finishing teeth die being set downstream of said helical teeth forming die and said aligning teeth die in a shaft rolling operation.

3. A method of forming helical splines with stoppers on a rotary shaft according to claim 2, in which said aligning teeth die and said finishing teeth die are provided as one unit.

4. A rolling tool for forming helical splines with stoppers on a shaft which comprises:

a helical teeth forming die having a plurality of inclined teeth at equal intervals;

an aligning teeth die having aligning teeth which are aligned with every other inclined tooth when combined with said helical teeth forming die, each stopper being produced in the space between aligning teeth on the shaft, each stopper having a configuration different than said helical teeth and said aligning teeth; and a finishing teeth die having a plurality of finishing teeth which are equal in pitch to said aligning teeth and every other inclined tooth, said finishing teeth die being set downstream of said helical teeth forming die and said aligning teeth die in a shaft rolling operation.

5. A rolling tool as claimed in claim 4, in which said aligning teeth die and said finishing teeth die are provided as one unit.

* * * * *